United States Patent [19]

Renton

[11] 4,414,910

[45] Nov. 15, 1983

[54] ASSEMBLY OF TURNABLE MEMBER AND MOUNTING THEREFOR

[75] Inventor: Julian Renton, London, England

[73] Assignee: RWO (Marine Equipment) Limited, Benfleet, England

[21] Appl. No.: 431,622

[22] Filed: Sep. 30, 1982

Related U.S. Application Data

[63] Continuation of Ser. No. 215,016, Dec. 10, 1980, abandoned.

[30] Foreign Application Priority Data

Dec. 19, 1979 [GB] United Kingdom ..... 7943785

[51] Int. Cl.[3] ..... B63B 21/04

[52] U.S. Cl. ..... 114/218; 24/134 P; 403/368; 403/372

[58] Field of Search ..... 114/218; 24/134 R, 134 P; 403/368, 372, 367, 365; 301/9 DH, 9 AH, 9 S, 301/18, 112, 122

[56] References Cited

U.S. PATENT DOCUMENTS

| | | | |
|---|---|---|---|
| 2,725,692 | 12/1955 | Andreae | 403/372 X |
| 3,338,600 | 8/1967 | Wahl | 403/372 X |
| 3,730,129 | 5/1973 | Helms | 114/218 |
| 3,809,435 | 5/1974 | Morris | 301/122 X |

*Primary Examiner*—Sherman D. Basinger
*Attorney, Agent, or Firm*—James & Franklin

[57] ABSTRACT

An assembly is disclosed comprising a turnable member and a mounting therefor. The turnable member may be one cam of a cam set for gripping a rope and acting as a cleat. The turnable member has a through bore and is mounted on a pillar of a mounting member by a plastics sleeve which is deformable so that a press fit of the pillar in the sleeve is achieved. The sleeve may have a flange by which the turnable member is retained in position. The assembly may be assembled in a factory as a unit and can be mounted by passing a screw or bolt through the assembly.

24 Claims, 3 Drawing Figures

ASSEMBLY OF TURNABLE MEMBER AND MOUNTING THEREFOR

This is a continuation, of application Ser. No. 215,016, filed 12/10/80, now abandoned.

FIELD OF THE INVENTION

This invention relates to an assembly of a turnable member and mounting therefor. The mounting is particularly suitable for a cam of a cam set which is used to grip a rope under load but it is to be appreciated that the mounting may be used for mounting a wide variety of members which have to be turned or rotated about an axis which is central of the mounting.

BACKGROUND OF THE INVENTION

A cam set used to grip a rope under load, usually so as to act as a cleat in a sailing craft, comprises two arcuate cam members each of which is mounted for turning movement about an axis such that the cam members engage or substantially engage one another at or near one end of their arcuate cam surfaces. Each cam member is spring loaded on its mounting so that the cam members can be turned in opposite directions to widen the gap between them against the action of the spring loading which seeks to restore the cams to their position of engagement. When the cam set is used as a cleat, a rope is pulled between the cam members so that the cam members open against the action of the springs and the cam members engage the rope when the latter is released. The cam members are provided with teeth or other projections for enhancing the grip of the arcuate surfaces on the rope.

Heretofore each cam set has comprised a number of mounting plates which have been individually assembled in place. This is inconvenient and can cause difficulties if it should become necessary to change a cam member or cam set at sea; particularly in rough seas.

It is an object of the invention to provide an assembly of a cam for such a cam set or other turnable or rotatable member and a mounting therefor, which mounting is simple and convenient to assemble.

SUMMARY OF THE INVENTION

According to one aspect of the present invention there is provided an assembly comprising:

a turnable member having a through bore and intended to be mounted for turning about the longitudinal axis of said through bore;

a mounting member;

a pillar to said mounting member, the mounting member having a through bore coaxial with said pillar; and a deformable sleeve member of plastics material; the sleeve member being shaped to fit within the bore in the turnable member and the pillar being shaped to fit within the sleeve such that, by deformation of the sleeve, a press fit of the pillar in the sleeve is achieved sufficient to hold the assembly together during transport.

The assembly can be mounted in position by passing fixing means, such as a screw or bolt, through the bore in the mounting member.

The sleeve is preferably closed at one end by an integral apertured disc formed with a flange of a diameter greater than the diameter of the bore in the turnable member, so that the turnable member need not be a press fit on the sleeve and may be turnable about the sleeve, being retained on the mounting member by the flange. The mounting member conveniently has the form of a stud with a flange and central pillar which may be surrounded by a coil spring connecting the turnable member to the mounting member.

As indicated above, the turnable member is preferably one cam of a cam set for gripping a rope under load and acting as a cleat.

Accordingly, another aspect of the present invention provides a cleat for gripping a rope under load comprising:

two turnable arcuate cam members, one being substantially a mirror image of the other, and each having a through bore;

an arcuate cam surface to each member;

projections to each arcuate cam surface for enhancing the grip of the cam surface on a rope under load;

a mounting member for each cam member;

a pillar to each mounting member, each mounting member having a through bore coaxial with its pillar;

a deformable sleeve of plastics material shaped to fit by deformation, as a press fit, on each of said pillars and shaped to fit within the bore of the appertaining cam member; and fixing means passing through said pillars to retain and mount said turnable cam members in an operative arrangement where their arcuate cam surfaces can grip between them a rope under load.

DESCRIPTION OF THE DRAWINGS

In order to enable the invention to be more readily understood, reference will now be made to the accompanying drawings which illustrate diagrammatically and by way of example an embodiment thereof, and in which.

Figure 1:
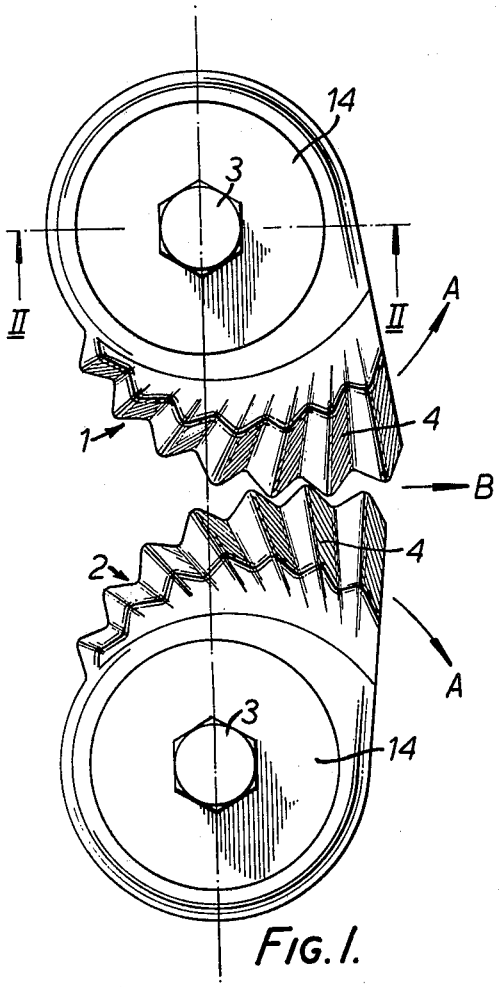
FIG. 1 is a side view of a cam set mounted to form a cleat.

DESCRIPTION OF THE PREFERRED EMBODIMENT:

Referring now to FIG. 1, there is shown a cam set comprising two cams 1 and 2 mounted to form a cleat, the cam 2 being a mirror image of the cam 1. The cams are mounted in position by bolts 3 so as to be pivoted in the directions of the arrows A against the action of coil springs (not shown) which urge the cams into the position shown where they engage against each other along their cam surfaces. The cams shown in FIG. 1 are formed with teeth 4 which taper inwardly of the cam from adjacent the mounting surface so that the space between the teeth widens progressively in the outward direction.

In the use of the cam set as a cleat, a rope to be held by the cam set is pulled through between the teeth 4 in the direction of the arrow B. The engagement of the rope with the teeth causes the cams to turn or pivot in the directions of the respective arrows A so that the body of the rope can lie fully between the teeth. When the tension on the rope is released, the cams are urged back by the coil springs in directions contrary to the arrows A and firmly grip the rope to prevent further movement of the rope in a direction contrary to the arrow B. The rope can be released by pulling in the direction of the arrow B and if required, moving it sideways to free it from engagement by the teeth.

Such cam sets are, in general, well known and it will be appreciated the actual shape of the cams and the, or any, teeth on the engaging arcuate cam surfaces may be the subject of wide variations.

Heretofore, the individual cams of such cam sets have been mounted in place using a number of pieces which have had to be individually positioned. This is inconvenient at the best of times but can cause difficulties if the mounting has to be effected at sea under rough conditions, for example, if a cam has to be replaced or remounted.

Figure 2:
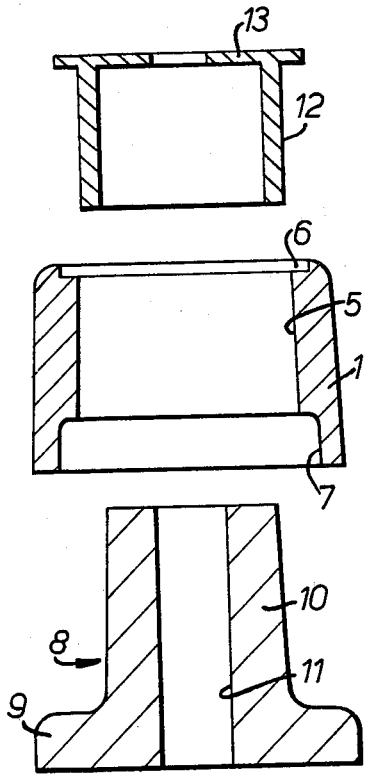
FIG. 2 is an exploded cross-sectional view of the line II—II in FIG. 1 with some parts omitted.
Figure 3:
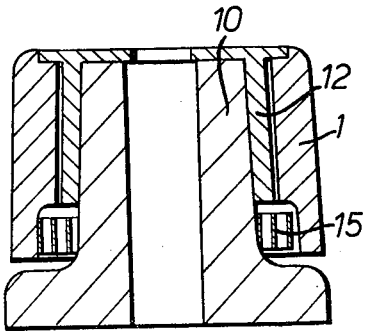
FIG. 3 is a cross-sectional view of the parts shown in FIG. 2 in an assembled condition.

Referring now to FIGS. 2 and 3, there is shown a mounting for a cam 1 by which the cam and the ancilliary parts can be held in an assembled condition ready for mounting. As shown in FIGS. 2 and 3, the cam has a central bore 5 which has a slight draft or inward taper from the bottom to the top, the draft conveniently being about 2°, the cam being made of a pressure diecast aluminium alloy so that the required draft can be obtained with some degree of accuracy. In its upper surface, the cam is formed with a recess 6 and in its lower surface the cam is formed with a recess 7, both recesses being coaxial with the bore 5.

The mounting comprises a hot stamped aluminium alloy base in the form of a stud 8 with a flange 9 and a central pillar 10 formed with a central bore 11. The central pillar 10 has also a slight draft or taper away from the flange, this draft also conveniently being about 2°. The mounting also comprises a sleeve 12 of moulded plastics with a parallel internal bore and closed at one end by an integral centrally-apertured disc 13.

In order to assemble the cam and its mounting, the sleeve 12 is placed in the central bore 5 in the cam so that the disc 13 rests in the recess 6. A coil spring 15 is then, or previously, fitted inside the recess 7 with one end of the spring attached to a mounting (not shown) in the cam. The cam and sleeve are then pressed over the central pillar of the base 8, while ensuring the attachment of the other end of the coil spring to a mounting (also not shown) near the base of the pillar.

Due to the fact that the pillar and the bore in the cam have a slight draft, whereas the sleeve has a parallel bore, the assembly results in deformation of the sleeve to provide a snug press fit of the sleeve on the pillar and the cam and coil spring are retained in position by engagement of the disc 13 in the recess 6 to provide an an assembly which can then easily be mounted by placing a washer 14 (FIG. 1) over the disc 13 and passing a bolt 3 through the assembly, the sleeve then acting as a bearing for the cam.

The cams and mounting can be assembled at a location remote from where they are to be fixed so that the replacement of a damaged or worn cam set is simplified; there is not a number of components to become separated during transport to or while at the fixing site.

It will be appreciated that many modifications of the mounting are possible and the shapes of the base and sleeve may be varied, as may the draft of the pillar and the bore of the cam, so long as the cam is a press fit between the sleeve and the pillar sufficient to hold the assembly together at least during transport to the fixing site.

It will also be appreciated that while the invention has been particularly described with reference to the mounting of a cam for a cam set to act as a cleat, the invention is applicable to members other than cams which are to be mounted so as to be turnable about an axis, particularly where such members and their mountings comprise a number of individual parts which it is preferable to assemble at a factory or other location remote from where the member is to be fixed.

I claim:

1. An assembly comprising:

a turnable member having a through bore and intended to be mounted for turning about the longitudinal axis of the through bore;

a mounting member;

a pillar to the mounting member, the mounting member having a through bore coaxial with the pillar, the through bore of the turnable member and the outer surface of the pillar being tapered; and a deformable sleeve member of plastics material; the sleeve member being shaped to fit within the through bore in the turnable member and the pillar being shaped to fit within the sleeve such that, by deformation of the sleeve, a press fit of the pillar in the sleeve is achieved sufficient to hold the assembly together during transport while still permitting rotation of the turnable member relative to the pillar.

2. The assembly of claim 1, wherein the sleeve is closed at one end by an integral apertured disc having a diameter greater than the diameter of the bore in the turnable member, the turnable member being turnable about the sleeve and retained on the mounting member by a peripheral region of the disc.

3. The assembly of claim 2, wherein the through bore in the turnable member and the outer surface of the pillar are similarly tapered.

4. The assembly of claim 1, wherein the mounting member is in the form of a stud having a flange and a central pillar.

5. The assembly of claim 1, wherein the turnable member is connected to the mounting member by a coil spring surrounding the pillar.

6. The assembly of claim 5, wherein the coil spring is accommodated in an internal recess in the turnable member.

7. The assembly of claim 1, wherein the turnable member is one cam of a cam set for gripping a rope under load and acting as a cleat.

8. The assembly of claim 1, wherein the turnable member is at all points spaced from the pillar.

9. The assembly of claim 1, wherein the inner and outer sidewalls of the sleeve are substantially untapered.

10. The assembly of claim 9, wherein the through bore in the turnable member and the outer surface of the pillar are similarly tapered.

11. The assembly of claim 1, wherein the through bore in the turnable member and the outer surface of the pillar are similarly tapered.

12. The assembly of claim 11 wherein the through bore of the turnable member and the outer surface of the pillar are equally tapered, thereby to define an angular passage of constant width.

13. The assembly of claim 12, wherein the angular passage is wider than the thickness of the sleeve.

14. The assembly of claim 13, wherein the sleeve is essentially of constant thickness.

15. A cleat for gripping a rope under load comprising:

two turnable arcuate cam members, one being substantially a mirror image of the other, and each having a through bore;

an arcuate cam surface to each cam member;

projections to each arcuate cam surface for enhancing the grip of the cam surface on a rope under load;

a mounting member for each cam member;

a pillar to each mounting member, each mounting member having a through bore coaxial with its pillar, the through bore of each cam member and the outer surface of the pillar thereto being tapered;

a deformable sleeve of plastics material shaped to fit, by deformation, as a press fit on each of the pillars without limiting rotation of the cam member relative to the pillar, the sleeve being shaped to fit within the bore of the appertaining cam member; and fixing means passing through the pillars to retain and mount said cam members in an operative arrangement where their arcuate cam surfaces can grip between them a rope under load.

16. The cleat of claim 15, further comprising spring means for biasing the cam members to a rope-gripping position.

17. The cleat of claim 16, wherein the through bore in the cam member and the outer surface of the pillar are similarly tapered.

18. The cleat of claim 15, wherein the cam members are at all points spaced from the pillars.

19. The cleat of claim 15, wherein the inner and outer sidewalls of the sleeve are substantially untapered.

20. The cleat of claim 19, wherein the through bore in the cam member and the outer surface of the pillar are similarly tapered.

21. The cleat of claim 15, wherein the through bore in the cam member and the outer surface of the pillar are similarly tapered.

22. The cleat of claim 21, wherein the through bore of the cam member and the outer surface of the pillar are equally tapered, thereby to define an angular passage of constant width.

23. The cleat of claim 22, wherein the angular passage is wider than the thickness of the sleeve.

24. The cleat of claim 23, wherein the sleeve is essentially of constant thickness.

* * * * *